US008913942B2

(12) United States Patent
Yamaguchi et al.

(10) Patent No.: US 8,913,942 B2
(45) Date of Patent: Dec. 16, 2014

(54) FORMATION PROCESS FOR GLOSSY SURFACE

(71) Applicant: Konica Minolta , Inc., Toyko (JP)

(72) Inventors: Go Yamaguchi, Hachioji (JP); Akihiro Honya, Musashino (JP); Sadaaki Sakamoto, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/970,644

(22) Filed: Aug. 20, 2013

(65) Prior Publication Data

US 2014/0064809 A1 Mar. 6, 2014

(30) Foreign Application Priority Data

Sep. 4, 2012 (JP) ..... 2012-194296

(51) Int. Cl.

| | |
|---|---|
| ***G03G 15/20*** | (2006.01) |
| ***B32B 27/00*** | (2006.01) |
| ***B32B 27/40*** | (2006.01) |
| ***G03G 15/00*** | (2006.01) |

(52) U.S. Cl.

CPC ..... *G03G 15/2057* (2013.01); *G03G 15/6573* (2013.01); *G03G 15/6585* (2013.01); *G03G 2215/0081* (2013.01)

USPC ..... 399/341; 428/423.1

(58) Field of Classification Search

USPC ..... 399/341, 302, 308; 428/423.1, 473.5

See application file for complete search history.

(56) References Cited

U.S. PATENT DOCUMENTS

| | | | | |
|---|---|---|---|---|
| 7,700,255 | B2 * | 4/2010 | Kurachi et al. | 430/125.32 |
| 2012/0049124 | A1 * | 3/2012 | Wu et al. | 252/500 |

FOREIGN PATENT DOCUMENTS

| | | |
|---|---|---|
| JP | 2002-099168 A | 4/2002 |
| JP | 2002-099169 A | 4/2002 |

* cited by examiner

*Primary Examiner* — Billy Lactaoen

(74) *Attorney, Agent, or Firm* — Lucas & Mercanti, LLP

(57) ABSTRACT

A formation process of a glossy surface, without unevenness of gloss in a image on a print surface, nor toner offset or release failure over a long time period, is provided, where a surface of a belt member is composed of a resin containing structural units derived from a specific urethane (meth)acrylate (A), a specific polyfunctional monomer (B), and a fluorine-modified acrylate (C) and has the contact angle with respect to water of 85 to 110°, and the melting energy ΔH of a wax in a clear toner is 2 to 20 J/g.

7 Claims, 2 Drawing Sheets

FORMATION PROCESS FOR GLOSSY SURFACE

CROSS-REFERENCE TO RELATED APPLICATION

This application is based on Japanese Patent Application No. 2012-194296 filed on Sep. 4, 2012, the contents of which are incorporated herein by reference.

BACKGROUND

1. Technical Field

The present invention relates to a formation process for a glossy surface. More particularly, it relates to a formation process for a glossy surface using a clear toner.

2. Description of Related Arts

Printed matter as represented by a photograph or a poster can now be prepared by an ink jet apparatus or an image formation apparatus according to an electrophotographic system owing to recent development of digital processing technology, in addition to a silver halide photography system or a printing system such as gravure printing which have been long used. For some of printed matter such as a photograph and a poster prepared by the image formation apparatus as described above is required a high gloss image with such finished quality that the entire area of a recording material should present a uniform and glossy surface.

A high gloss image means an image with so-called photographic quality, and specifically an image whose 60° gloss is 50 or more. In this connection, with respect to a higher gloss image with the 60° gloss of 80 or more, a 20° gloss method is applied and its gloss is expressed by a measured 20° gloss.

In order to form such a high gloss image, a process has been known, in which a clear toner is supplied onto an image carrier, and the clear toner is fixed by a release-after-cooling fixation method. For example in Patent Literature 1 (JP-A-No. 2002-99168) and Patent Literature 2 (JP-A-No. 2002-99169) is disclosed a fixation apparatus for a glossy surface, equipped with a heating roll, a strip roll placed with certain distance to the heating roll, an endless belt circulating spanned at least by the strip roll and the heating roll, a press roll pressing the endless belt against the heating roll, and a cooling structure placed on the side of an inner circumferential surface of the endless belt and having a pressing and cooling surface, which presses and cools such a part of the belt inner circumferential surface of the endless belt as from the heating roll up to the strip roll to the direction of the external circumferential surface of the belt.

SUMMARY

There has been, however, a drawback with respect to printed matter outputted by an apparatus disclosed in Patent Literature 1 and 2 in that uniformity of gloss in an image surface cannot be attained and unevenness of gloss appears, which is significant especially for a recording medium with heavier weight (basis weight) such as paperboard.

In a glossy surface formation process using the apparatus, a clear toner is fully molten by applying heat and pressure, then contacted with a smooth belt, and conveyed and cooled adequately in a closely adhered state, so that the surface of the clear toner closely adhered to the facing belt can solidify maintaining the smooth state to a smooth toner layer. As the result, high gloss can be imparted to an image surface, however when paperboard, etc. is used, due to significant own weight, the adherence between the belt and the clear toner layer is weakened under the influence of the paperboard weight and the belt and the clear toner layer, although only locally, come to a state just touching each other. In such a state, the clear toner is cooled in an elastically recovered state, a smooth surface require for the clear toner surface cannot be obtained any more.

Reversely, when the adherence between the belt and the clear toner layer is made stronger than necessary, toner offset may take place due to too strong adherence between the belt and the clear toner layer, or a failure in smooth release of a recording medium from the belt may take place at a release step, where a recording medium with a fixed image is released from the belt.

The present invention has been made under such circumstances with an object to provide a formation process of a glossy surface, by which an image without unevenness of gloss in a print surface can be formed, and toner offset or release failure does not occur, over a long time period.

In view of the object, the present inventors studied diligently. As the results, it was found surprisingly that the object could be attained by using a belt member composed of a specific cured resin and exhibiting a specific contact angle, and a clear toner containing a specific amount of wax, thereby completing the invention.

Namely, the present invention includes any of the following constitutions in order to attain at least one of the objects.

1. A formation process of a glossy surface comprising: a step for heating an image carrier to which a clear toner is supplied; a step for adhering closely the image carrier to a belt member by the intermediary of the clear toner molten in the above step; a step for cooling the image carrier in a state being closely adhered to the belt member; and a step for releasing the image carrier with the clear toner solidified lay the cooling from the belt member; wherein a surface of the belt member is composed of a cured resin comprising: (a) a structural unit derived from a urethane (meth)acrylate (A) having 3 or more (meth)acryloyloxy groups in a molecule; (b) a structural unit derived from a polyfunctional monomer (B) having 3 or more (meth)acryloyloxy groups in a molecule but no urethane bond; and (c) a structural unit derived from a fluorine-modified acrylate (C); and wherein the contact angle of the surface of the belt member with respect to pure water is 85 to 110°; the clear toner comprises a toner particle comprising a binder resin and a wax; and the melting energy ΔH determined from a melting peak area obtained from an endothermic peak of the wax obtained by a DSC measurement of the clear toner is 2 to 20 J/g.

2. The above formation process of a glossy surface, wherein preferably the cured resin contains 18 to 63 mass-% of a structural unit derived from the urethane (meth)acrylate (A), 18 to 63 mass-% of a structural unit derived from the polyfunctional monomer (B), and 1 to 40 mass-% of a structural unit derived from the fluorine-modified acrylate (C).

3. The above formation process of a glossy surface, wherein preferably the binder resin contains a styrene acrylic resin.

4. The above formation process of a glossy surface, wherein preferably the surface hardness of a surface (external circumferential surface) of the belt member on the side to be contacted with a toner layer measured by a nanoindentation technique is 0.35 to 2 GPa.

5. The above formation process of a glossy surface, wherein preferably a release layer is formed on the belt member and the thickness of the release layer is 0.1 to 50 μm.

6. The above formation process of a glossy surface, wherein preferably the softening point of the clear toner is 80 to 140° C.

7. The above formation process of a glossy surface, wherein preferably with respect to the entire binder resins contained in the clear toner, the number average molecular weight (Mn) is 3,000 to 6,000 and the ratio Mw/Mn of the weight average molecular weight (Mw) to the number average molecular weight (Mn) is 2.0 to 6.0.

DETAILED DESCRIPTION

Figure 1:
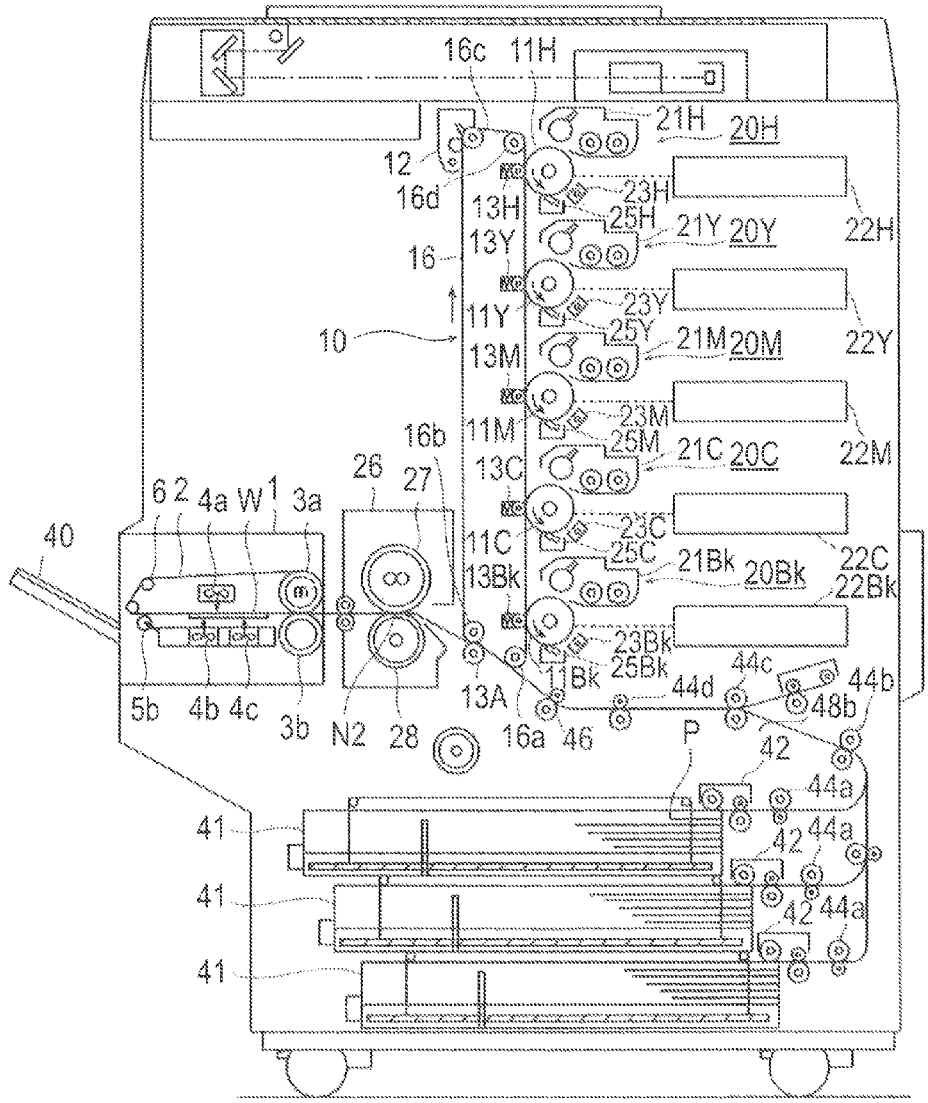
FIG. 1 is a schematic cross-sectional view illustrating an example of a structure of an image formation apparatus incorporating a high gloss treatment apparatus to exercise the formation process of a glossy surface according to the present invention.

According to the present invention is provided a formation process of a glossy surface comprising: a step for heating an image carrier to which a clear toner is supplied; a step for adhering closely the image carrier to a belt member by the intermediary of the clear toner molten in the above step; a step for cooling the image carrier in a state being closely adhered to the belt member; and a step for releasing the image carrier with the clear toner solidified by the cooling from the belt member; wherein a surface of the belt member is composed of a cured resin comprising: (a) a structural unit derived from a urethane (meth)acrylate (A) having 3 or more (meth)acryloyloxy groups in a molecule; (b) a structural unit derived from a polyfunctional monomer (B) having 3 or more (meth)acryloyloxy groups in a molecule but no urethane bond; and (c) a structural unit derived from a fluorine-modified acrylate (C); and wherein the contact angle of the surface of the belt member with respect to pure water is 85 to 110°; the clear toner comprises a toner particle comprising a binder resin and a wax; and the melting energy ΔH determined from a melting peak area obtained from an endothermic peak of the wax obtained by a DSC measurement of the clear toner is 2 to 20 J/g.

According to the formation process of a glossy surface, a toner layer on a carrier (an image and a clear toner) is cooled and conveyed while being adhered closely to a belt member, and finally released. The toner layer is constituted with an image formed on the carrier and a clear toner formed on the image, and the clear toner adheres to the belt member. When the adhesion between the belt member and the clear toner is weakened the releasability is enhanced and release becomes easier. However, if the adhesion is too weak, a phenomenon of "poor adhesion" is apt to appear such that the image is partly detached in travelling due to the own weight of paper, especially in the case of paperboard, and unevenness in gloss appears. On the contrary, if the adhesion between the belt member and the clear toner is too strong, another phenomenon happens such that due to difficulty in releasing the clear toner from the belt member, the releasability is compromised and offsetting of a toner onto the belt member occurs. As described above, balanced adhesion between a belt member and a clear toner is necessary, ensuring good adhesion at a step for heating and cooling a toner layer and good releasability at a step for releasing the same. Concerning the present invention it was found that the adhesion between a clear toner and a belt member induced by melting of the clear toner and the releasability of the clear toner from the belt member induced by bending of the belt member at a step for releasing can be balanced appropriately by constituting the belt member with a specific cured resin to exhibit a specific contact angle, and by adding a specific amount of a wax to the clear toner. In other words, by the glossy surface forming process according to the present invention, both appropriate adhesion and releasability between a belt member and a clear toner can be assured, and an image without unevenness of gloss in a surface can be formed. Further, according to the present invention, good balance of the elasticity owing to a structural unit derived from a urethane (meth)acrylate (A) and the hardness owing to a structural unit derived from a polyfunctional monomer (B) and tenacity can be exhibited and good abrasion resistance against a stress from friction or a stress from releasing can be obtained, the initial adhesion and releasability can be maintained over a long time period.

The present invention will be described in details below.

FIG. 1 is a schematic cross-sectional view illustrating an example of a structure of an image formation apparatus incorporating a nigh gloss treatment apparatus to exercise the formation process of a glossy surface according to the present invention.

The image formation apparatus is a tandem color image formation apparatus, which can exercise continuously an image formation treatment and a high gloss treatment on a toner layer.

The image formation apparatus includes clear toner image formation section 20H for forming a clear toner image constituting the uppermost layer of a toner layer to be subjected to a high gloss treatment and to contact directly a belt 2 for a nigh gloss treatment (illustrated in a high gloss treatment apparatus 1 described below); chromatic toner image formation sections 20Y, 20M, 20C, and 20Bk for forming a yellow, magenta, cyan or black chromatic toner image individually; an intermediate transfer section 10 for transferring toner images formed at the clear toner image formation section 20H and chromatic toner image formation sections 20Y, 20M, 20C and 20Bk to a recording material P; a fixation apparatus 26 for carrying out a fixation treatment for yielding a toner layer by pressing a toner images under heating against the recording material P for fixation; and a high gloss treatment apparatus 1 for smoothening the toner layer surface.

At the chromatic toner image formation section 20Y is formed a yellow toner image; at the chromatic toner image formation section 20M is formed a magenta color toner image; at the chromatic toner image formation section 20C is formed a cyan color toner image; and at the chromatic toner image formation section 20Bk is formed a black toner image.

The clear toner image formation section 20H is equipped with a photoreceptor 11H, which is an electrostatic latent image carrier; a charging means 23H, which applies uniform electric potential to the surface of the photoreceptor 11H; an exposure means 22H for forming an electrostatic latent image with a desired shape on the uniformly charged photoreceptor 11H; a developing means 21H for visualizing the electrostatic latent image by conveying the clear toner on to the photoreceptor 11H; and a cleaning means 25H for recovering a residual toner remaining on the photoreceptor 11H after a primary transfer.

While, the chromatic toner image formation sections 20Y, 20M, 20C, and 20Bk are equipped with photoreceptors 11Y, 11M, 11C, and 11Bk, which are electrostatic latent image carriers; charging means 23Y, 23M, 23C, and 23Bk, which apply uniform electric potential to the surfaces of the photoreceptor 11Y, 11M, 11C, and 11Bk; exposure means 22Y, 22M, 22C, and 22Bk for forming electrostatic latent images with a desired shape on the uniformly charged photoreceptors 11Y, 11M, 11C, and 11Bk; developing means 21Y, 21M, 21C, and 21Bk for visualizing the electrostatic latent images by conveying the chromatic toners on to the photoreceptors 11Y, 11M, 11C, and 11Bk, and cleaning means 25Y, 25M, 25C, and 25Bk for recovering residual toners remaining on the photoreceptors 11Y, 11M, 11C, and 11Bk after a primary transfer.

The intermediate transfer section 10 is equipped with an intermediate transfer body 16; a primary transfer roller 13H for transferring the clear toner image formed by the clear toner image formation section 20H to the intermediate transfer body 16; primary transfer rollers 13Y, 13M, 13C, and 13Bk for transferring the chromatic toner images formed by the chromatic toner image formation sections 20Y, 20M, 20C, and 20Bk to the intermediate transfer body 16; a secondary transfer roller 13A for transferring the clear toner image transferred by the primary transfer roller 13H on to the intermediate transfer body 16 and the chromatic toner images transferred by the primary transfer rollers 13Y, 13M, 13C, and 13Bk on to the intermediate transfer body 16, onto a recording material P; and a cleaning means 12 for recovering residual toners remaining on the transfer body 16.

The intermediate transfer body 16 is in a form of an endless belt spanned and supported rotatably by a plurality of support rollers 16*a* to 16*d*.

The fixation apparatus 26 is constituted by a pair of heat-pressing rollers 27 and 28 contacting each other under pressure forming a nipping section N2 at the contacting section.

[High Gloss Treatment Apparatus]

Next, referring to FIG. 2 a high gloss treatment apparatus, an embodiment of a glossy surface treatment process according to the present invention will be described.

The high gloss treatment apparatus 1 can perform a series of steps on a processed body W prepared by forming a toner layer T on the recording material P from a step for heating and pressing, then cooling, and up to release from a high gloss treatment belt 2. In this regard, a recording material P herein also referred to as a "carrier", and a processed body W with a formed toner layer (an image and a clear toner; is referred to as an "image carrier supplied with a clear toner" or "image carrier". The "image carrier" means herein that at least an image is formed thereon and particularly a toner layer (an image and a clear toner) is formed thereon.

The high gloss treatment apparatus 1 is, specifically, equipped with a heating roller 3*a* driven at a constant speed; an endless high gloss treatment belt 2 having a smooth surface spanned by a heating roller 3*a*, a release roller 3*a* and a support roller 6 to direct the smooth surface as an external circumferential surface; and a pressing roller 3*b* placed to press the nigh gloss treatment belt 2 against the heating roller 3*a* forming a nipping section N between the same and the high gloss treatment belt 2; and further equipped with a release-after-cooling system including a cooling mechanism 4 placed downstream, in the travelling direction of the high gloss treatment belt 2, of the heating roller 3*a* and upstream of the release roller 5*a*; and a release mechanism 5 placed near the release roller 5*a* and downstream of the cooling mechanism 4.

The heating roller 3*a* and the pressing roller 3*b* are placed in a state contacting each other under pressure by the intermediary of the nigh gloss treatment belt 2. Specifically, at least one of the heating roller 3*a* and the pressing roller 3*b* is provided with a silicone rubber layer or a fluorine rubber layer on the surface, so that the nipping section N is formed at a contact section between the heating roller 3*a* and the pressing roller 3*b*. The width of the nipping section M is preferably, for example, in a range of approx. 1 to 8 mm.

The heating roller 3*a* may be formed by covering the surface of a base body made of a metal such as aluminum, with an elastic body layer composed of a silicone rubber, etc. to a predetermined outer diameter. The heating roller 3*a* is so constituted that a halogen lamp of, for example, 300 to 350 W as a heat source 3*c* is provided internally, and that the surface temperature of the heating roller 3*a* can be heated from inside to a predetermined temperature.

The pressing roller 3*b* may be formed by covering the surface of a base body made of a metal such as aluminum, with an elastic body layer composed of a silicone rubber, etc. and further covering the surface of the elastic body layer with a release layer composed of a tube of a PFA (a tetrafluoroethylene-perfluoroalkyl vinyl ether copolymer) to a predetermined outer diameter. The pressing roller 3*b* is constituted without a heat source. The pressing roller 3*b* may be optionally provided with a cooling apparatus.

The cooling mechanism 4 is composed of a cooling fan 4*a* placed in a region between the heating roller 3*a* and the release roller 1*a* existing on the inner circumferential surface side of tire high gloss treatment belt 2 and spanning the belt, in a noncontact state with the high gloss treatment belt 2 and supplying cooling air toward the region, and a cooling mechanism composed of 2 cooling fans 4*b* and 4*c* placed in the region between the pressing roller 3*b* and the auxiliary conveying roller 5*b* on the external circumferential surface side of the high gloss treatment belt 2, in a noncontact state with the high gloss treatment belt 2 and supplying cooling air toward the region, and a heat sink 4*d* connected therewith respectively. Owing to such a constitution of the cooling mechanism 4, a cooling region Co is formed in a region between the heating roller 3*a* and the release roller 5*a* on the external circumferential surface side of the high gloss treatment belt 2.

The release mechanism 5 is constituted with a bending section of the high gloss treatment belt 2, where the circulatory travelling direction of the high gloss treatment belt 2 changes greatly, formed by arranging the release roller 5*a*, the heating roller 3*a* and support roller 6 in a positional relationship forming an acute angle with the release roller 5*a* as a fulcrum, and the auxiliary conveying roller 5*b* placed facing the release roller 5*a* with a clearance same as or slightly larger than the thickness of a processed body W, which is constituted by forming a toner layer T on a recording material P.

The roller diameter of the release roller 5*a* may be selected such that the curvature of the same is regulated in accordance with the stiffness of the recording material P to release a processed body W from the high gloss treatment belt 2 in the release mechanism 5, and is preferably, for example, 10 to 40 mmϕ.

First, a belt member and a clear toner to be used in a glossy surface treatment process according to the present invention will be described.

[Belt Member]

With respect to a high gloss treatment belt 2 to be used in a formation process of a glossy surface according to the present invention, a surface (external circumferential surface) is formed as a smooth surface. A formation process of a glossy surface according to the present invention has a characteristic in the high gloss treatment belt. A high gloss treatment belt is herein also called as a "belt member". The belt member is a member that has a belt shape and contacts an image carrier and/or a toner during image formation.

A belt member according to the present invention is prepared by forming a surface layer composed of a specific cured resin on a belt base body having a belt shape, and characterized in that the surface layer is composed of a cured resin containing: (a) a structural unit derived from a urethane (meth)acrylate (A) having 3 or more (meth)acryloyloxy groups in a molecule; (b) a structural unit derived from a polyfunctional monomer (B) having 3 or more (meth)acryloyloxy groups in a molecule but no urethane bond; and (c) a structural unit derived from a fluorine-modified acrylate (C). When the surface of the belt member is constituted with a cured resin containing specific several binds of constituent units, the contact angle of the surface of the belt member with respect to pure water is 85 to 110°, and as the result the belt member is superior in adhesion and releasability with/from a specific clear toner.

Namely, in a belt member the contact angle of a surface to contact a toner layer T (an external circumferential surface) is 85 to 110° with respect to pure water, and preferably 90 to 105°. If the contact angle of a belt member is less than 85°, separation of a processed body W from the release roller 5*a* may become difficult, and if the contact angle of a belt member exceeds 110°, the adhesion of a toner layer on to a surface of a recording material P may become insufficient, and offsetting of the toner to the belt member may take place.

While, the contact angle means herein a contact angle of a surface of a belt member with respect to pure water. Further, according to the present invention, it is a mean value of measurements at 10 arbitrary points in an environment of a temperature of 20° C. and a humidity of 50% RH by a contact angle meter "Model CA-DT-A" (by Kyowa Interface Science Co., Ltd.)

While, in a formation process of a glossy surface according to the present invention, a cured resin contains preferably a structural unit derived from the urethane (meth)acrylate (A) at the content of 18 to 63 mass-%, a structural unit derived from the poly functional monomer (B) at the content of 18 to 63 mass-%: and a structural unit derived from the fluorine-modified acrylate (C) at the content of 1 to 40 mass-% When a cured resin is constituted according to the above range, durability derived from a urethane (meth)acrylate (A) and a polyfunctional monomer (B), and releasability of a belt member derived from a fluorine-modified acrylate (C) are favorably exhibited.

A cured resin constituting a surface of a belt member will be described below.

[Urethane (meth)acrylate (A)]

As a urethane (meth)acrylate (A), any compound having a urethane bond as well as 3 or more (meth)acryloyloxy groups in a molecule can be used without particularly restriction.

Examples of a urethane (meth)acrylate (A) include those having a urethane bond in the main chain and 3 or more (meth)acryloyloxy groups bonding to an end of the main chain or to a side chain. As for a (meth)acryloyloxy group in the methane (meth)acrylate (A) its number may be 3 or more, but is preferably 4 or more, more preferably 5 or more, and further preferably 6 or more.

Specific examples of the urethane (meth)acrylate (A) include a reaction product of a polyol compound (a1) having 2 or more hydroxy groups in a molecule, a polyisocyanate compound (a2), and an acrylate compound (a3) having a hydroxy group and an acryloyloxy group in a molecule; and a reaction product of a polyisocyanate compound (a2), and an acrylate compound (a3) having a hydroxy group and an acryloyloxy group in a molecule.

A reaction product of a polyol compound (a1), a polyisocyanate compound (a2) and an acrylate compound (a3) can be yielded by reacting a polyol compound (a1) and a polyisocyanate compound (a2) to form a so-called urethane prepolymer having an isocyanate group, and then reacting the same with an acrylate compound (a3).

More specifically, first a polyol compound (a1) and a polyisocyanate compound (a2) are reacted to form a urethane prepolymer similarly as in a normal synthesis of a urethane prepolymer, at a composition containing an excessive isocyanate group. The equivalent ratio (isocyanate group/hydroxy group) for the reaction is preferably 1.2 to 2.5, and more preferably 1.5 to 2.2.

Next, an isocyanate group of the yielded urethane prepolymer and a hydroxy group of an acrylate compound (a3) are reacted to form a urethane (meth)acrylate (A).

Meanwhile, a reaction product of a polyisocyanate compound (a2) and acrylate compound (a3) can be yielded by reacting an isocyanate group of the polyisocyanate compound (a2) and a hydroxy group of the acrylate compound (a3).

(Polyol Compound (a1))

As a polyol compound (a1) those having 2 or more hydroxy groups can be used without particularly restriction.

Examples of the polyol compound include a high molecular weight polyol, such as a polyether polyol, and a polyester polyol; and a low molecular weight polyol, such as triethylene glycol, and 1,6-hexanediol; which may be used singly or in a combination of 2 or more.

As a polyol compound (a1), those with the molecular weight of 500 or less are favorably used by reason of superior curability and improved hardness of an obtained specific surface layer, and especially a low molecular weight polyol having the skeleton composed of an alicyclic hydrocarbon, namely a low molecular weight cyclic alcohol is used more favorably by reason of further improvement in the hardness of an obtained specific surface layer.

Specific examples of the low molecular weight cyclic alcohol include 1,4-cyclohexanediol, and tricyclodecanedimethanol.

(Polyisocyanate Compound (a2))

As a polyisocyanate compound (a2) those having 2 or more isocyanate groups in a molecule can be used without particularly restriction.

Specific examples of the polyisocyanate compound include an aromatic polyisocyanate, such as TDI (e.g., 2,4-tolylene diisocyanate (2,4-TDI), and 2,6-tolylene diisocyanate (2,6-TDI)), MDI (e.g., 4,4'-diphenylmethane diisocyanate (4,4'-MDI), and 2,4'-diphenylmethane diisocyanate (2,4'-MDI)), 1,4-phenylene diisocyanate, polymethylene polyphenylene polyisocyanate, xylylene diisocyanate (XDI), tetramethylxylylene diisocyanate (TMXDI), toluidine diisocyanate (TODI), 1,5-naphthalene diisocyanate (NDI), and triphenylmethane triisocyanate; an aliphatic polyisocyanate, seen as hexamethylene diisocyanate (HDI), trimethylhexamethylene diisocyanate (TMHDI), lysine diisocyanate, and norbornane diisocyanate (NBDI); an alicyclic polyisocyanate, such as trans-cyclohexane-1,4-diisocyanate, isophorone diisocyanate (IPDI), bis(isocyanatemethyl)cyclohexane ($H_6$XDI), and dicyolohexylmethane diisocyanate ($H_{12}$MDI); a carbodiimide-modified polyisocyanate therefrom; and an isocyanurate-modified polyisocyanate therefrom.

Among them, tolylene diisocyanate (TDI) is preferably used by reason that the viscosity of a specific polymerizable composition described below can be decreased to achieve a good coating property (operability).

The polyisocyanate compounds may be used singly or in a combination of 2 or more.

(Acrylate Compound (a3))

As an acrylate compound (a3), any acrylate having a hydroxy group and an acryloyloxy group in a molecule can be used without particularly restriction.

As an acrylate compound (a3), a polyfunctional acrylate compound having 2 or more acryloyloxy groups is preferably used so as to yield a urethane (meth)acrylate (A) having 3 or more acryloyloxy groups.

Specific examples of such a polyfunctional acrylate compound include trimethylolpropane diaorylate, pentaglycerol diacrylate, pentaerythritol triacrylate, dipentaerythritol triacrylate, dipentaerythritol tetraacrylate, and dipentaerythritol hexaacrylate.

In a specific cured resin according to the present invention, the content of a structural unit derived from a urethane (meth) acrylate (A) is 18 to 63 mass-%, and preferably 40 to 63 mass-%.

If the content of a structural unit derived from a urethane (meth)acrylate (A) in a specific cured resin is in the above range, it is preferable because the durability of a belt member becomes superior, and the balance of the adhesion and the releasability between a belt member surface and a specific clear toner becomes further superior.

A structural unit derived from a urethane (meth)acrylate (A) according to the present invention may be synthesized by a publicly known method, or a commercial product may be used. Examples of a commercial product of a structural unit derived from a urethane (meth)acrylate (A) include urethane acrylates from Shin-Nakamura Chemical Co., Ltd. (U-4HA, U-6HA, U-6LPA, UA-1100H, UA-53H, and UA-33H).

[Polyfunctional Monomer (B)]

As a polyfunctional monomer (B), any compound having 3 or more (meth)acryloyloxy groups in a molecule but no urethane bond; namely any compound having 3 or more (meth) acryloyloxy groups in a molecule other than the urethane (meth)acrylate (A), can be used without particularly restriction.

Specific examples of a polyfunctional monomer having 3 (meth)acryloyloxy groups in a molecule include trimethylolpropane tri(meth)acrylate, pentaerythritol tri(meth)acrylate, and dipentaerythritol tri(meth)acrylate.

Specific examples of a polyfunctional monomer having 4 (meth)acryloyloxy groups in a molecule include pentaerythritol tetra(meth)acrylate, dipentaerythritol tetra(meth)acrylate, and tripentaerythritol tetra(meth)acrylate.

Specific examples of a polyfunctional monomer having 5 or more (meth)acryloyloxy groups in a molecule include dipentaerythritol penta(meth)acrylate, dipentaerythritol hexa (meth)acrylate (DPHA), tripentaerythritol penta(meth)acrylate, tripentaerythritol hexa(meth)acrylate, tripentaerythritol hepta(meth)acrylate, and tripentaerythritol octa(meth)acrylate.

Among them, a polyfunctional monomer having 3 (meth) acryloyloxy groups in a molecule is preferably used, and more preferably a polyfunctional monomer having 3 acryloyloxy groups in a molecule is used by reason that the viscosity of a specific polymerizable composition described below can be lowered, and the adhesion of a specific surface layer yielded from the specific polymerizable composition to a belt substrate is improved.

Further, by reason that the obtained hardness of a specific surface layer and adhesion to a belt substrate are improved further, and the fast curability, water resistance, solvent resistance, and chemical resistance are superior, trimethylolpropane triacrylate, pentaerythritol tetraacrylate, dipentaerythritol tetra(meth)acrylate, dipentaerythritol hexa(meth)acrylate (DPHA), or a compound expressed by the following formula (b1) is preferably used.

Further, by reason that the curability is superior, and the hardness of a specific surface layer is further improved, the use of a compound expressed by the following formula (b1) is preferable.

The above polyfunctional monomers (B) may be used singly or in a combination of 2 or more.

[Chem. Formula 1]

Formula (b1)

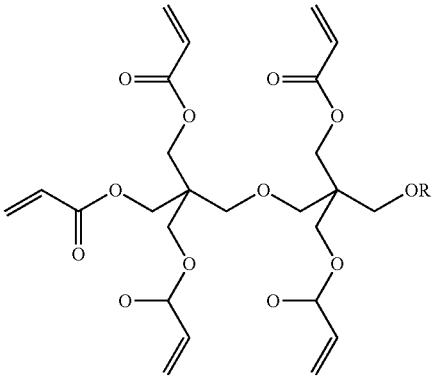

wherein R represents a hydrogen atom or a (meth)acryloyl group.

In a specific cured resin according to the present invention, the content of a structural unit derived from a polyfunctional monomer (B) is 18 to 63 mass-%, and preferably 30 to 45 mass-%.

If the content of a structural unit derived from a polyfunctional monomer (B) in a specific cured resin is in the above range, it is preferable because the durability of a belt member becomes superior, and the balance of the adhesion and the releasability between a belt member surface and a specific clear toner becomes further superior.

[Fluorine-Modified Acrylate (C)]

A fluorine-modified acrylate (C) includes fluorine-modified acrylate resins, and examples thereof include a copolymer of one each, or plural kinds of: fluorinated olefin monomers, such as tetrafluoroethylene, vinylidene fluoride, hexafluoropropylene, and a fluorinated vinyl ether; and (non-fluorine-modified) acrylic monomers, including esters of acrylic acid or methacrylic acid, such as alkyl esters with methyl, ethyl, butyl, octyl, dodecyl or the like, and hydroxyalkyl esters, with hydroxy ethyl, hydroxy butyl, or the like; and other usual acrylic monomers such as glycidyl ester.

As a fluorine-modified acrylate (C), a copolymer using tetrafluoroethylene or hexafluoropropylene as a fluorinated olefin monomer, and having the average molecular weight of 10,000 or more is preferable, by reason that a fluorine resin component, which is a low energy component, can permeate from the outermost surface to certain depth, and therefore even if the outermost surface wears out, the initial performance can be sustained.

In a specific cured resin according to the present invention, the content of a structural unit derived from a fluorine-modified acrylate (C) is 1 to 40 mass-%, and preferably 2 to 30 mass-%.

If the content of a structural unit derived from a fluorine-modified acrylate (C) in a specific cured resin is in the above range, sufficient releasability of a surface layer of a belt member can be attained.

A structural unit derived from a fluorine-modified acrylate (C) according to the present invention may be synthesized by a publicly known method, or a commercial product may be used. Examples of a commercial product of a structural unit derived from a fluorine-modified acrylate (C) include Megafac (RS-75, RS-72-K, RS-76-E, RS-76-NS, RS-77; by DIC Corporation)

[Belt Base Body]

A belt base body may be made of, for example, a polyimide resin, a polymethylmethacrylate resin, a polycarbonate resin, a polystyrene resin, an acrylonitrile-styrene copolymer resin, a polyvinyl chloride resin, an acetate resin, an ABS resin, a polyester resin, and a polyamide resin, and preferably made of a polyimide resin.

Although the thickness of a surface layer of a belt member is dependent on a use of the belt member, it is preferably e.g. 1 to 30 μm. If the thickness of a surface layer is less than 1 μm, the effect of suppression of surface deterioration of a belt substrate may not be obtained adequately, and if the thickness of a surface layer exceeds 30 μm, adequate adhesion to the belt substrate may not be obtained to cause a crack.

[Production Method of Belt Member]

As an example of a production method of a belt member according to the present invention, a specific polymerizable composition containing, for forming the specific cured resin on a belt base body, polymerizable components including a urethane (meth)acrylate (A), a polyfunctional monomer (B) and a fluorine-modified acrylate (C), a polymerization initiator (D), and according to need, another component such as a solvent, is coated to form, a coated film, which is irradiated with light for curing.

[Polymerization Initiator (D)]

As a polymerization initiator (D) contained in a specific polymerizable composition, any initiator can be used without particularly restriction, insofar as it can polymerize a urethane (meth)acrylate (A), a polyfunctional monomer (B) and a fluorine-modified acrylate (C) by light or heat.

Examples of an applicable polymerization initiator (D) include a photopolymerization initiator such as an acetophenone compound, a benzoin ether compound, a benzophenone compound, a sulfur compound, an azo compound, a peroxide compound, and a phosphine oxide compound. Specific examples include carbonyl compounds, such as benzoin, benzoin methyl ether, benzoin ethyl ether, benzoin isopropyl ether, acetoin, butyroin, toluoin, benzil, benzophenone, p-methoxybenzophenone, diethoxyacetophenone, α, α-dimethoxy-α-phenylacetophenone, methyl phenyl glycxylate, ethyl phenyl glyoxylate, 4,4'-bis (dimethylaminobenzophenone), 2-hydroxy-2-methyl-1-phenylpropan-1-one, 2,2-dimethoxy-1,2-diphenylethan-1-one, and 1-hydroxycyclohexyl phenyl, ketone; sulfer compounds, such as tetramethylthiuram monosulfide, and tetramethylthiuram disulfide; azo compounds, such as azobisisobutyronitrile, and azobis-2,4-dimethylvaleronitrile; and peroxide compounds, such as benzoyl peroxide, and di-t-butyl peroxide; and the above may be used singly or in a combination of 2 or more.

Among them, from a viewpoint of attainment of light stability, high efficiency in photocleavage, surface curability, compatibility with a specific cured resin, low volatility, and a low odor characteristic, use of 1-hydroxycyclohexyl phenyl ketone, 2-hydroxy-2-methyl-1-phenyl-propan-1-one, and 1-[4-(2-hydroxyethoxy)-phenyl]-2-hydroxy-2-methyl-1-prop an-1-one is preferable.

The content of a photopolymerization initiator (D) in a specific polymerizable composition is preferably 1 to 10 mass-%, and from viewpoints of superior curability and attainment of sufficient hardness of a specific surface layer to be yielded as well as good adhesion to a belt substrate, more preferably 2 to 8 mass-%, and further preferably 3 to 6 mass-%.

From a viewpoint of a good coating property (operability), a specific polymerizable composition preferably contains a solvent.

Specific examples of a solvent include ethanol, isopropanol; butanol, toluene, xylene, acetone, methyl ethyl ketone, ethyl acetate, and butyl acetate.

To the extent an object of the present invention is not jeopardized, various additives, such as a filler, an age resistor, an antistatic agent, a flame retardant, an adhesion promoter, a dispersant, an antioxidant, a defoaming agent, a leveling agent, a matting agent, and a light stabilizer (e.g. a hindered amine compound), and other components, such as a dyestuff, and a pigment, may be added.

Specific examples of a filler include organic and inorganic fillers, such as pyrophyllite clay, kaolin clay, calcined clay, fumed silica, calcined silica, precipitated silica, ground silica, melt silica, diatomaceous earth, iron oxide, zinc oxide, titanium oxide, barium oxide, magnesium oxide, calcium carbonate, manganese carbonate, zinc carbonate and carbon black; and the above treated with a fatty acid, a resin acid, a fatty acid ester and a fatty acid ester urethane compound.

Specific examples of an age resistor include a hindered phenol compound, and a hindered amine compound.

Specific examples of an antioxidant include butylhydroxytoluene (BHT), and butylhydroxyanisole (BHA).

Specific examples of an antistatic agent include hydrophilic compounds, such as a quaternary ammonium salt, polyglycol, and an ethylene oxide derivative.

Specific examples of a flame retardant include chloroalkyl phosphate, dimethyl methylphosphonate, a bromine/phosphorus compound, ammonium polyphosphate, neopentyl bromide-polyether, and a brominated polyether.

Specific examples of an adhesion promoter include a terpene resin, a phenol resin, a terpene-phenol resin, a rosin resin, a xylene resin, and an epoxy resin.

Specific examples of a leveling agent include a silicone leveling agent, an acrylic leveling agent, a vinyl leveling agent, and a fluorine leveling agent.

A specific polymerizable composition can be prepared by stirring well respective essential components and optional components under reduced pressure with a stirrer of a mixer, etc.

There is no particular restriction on a coating process of a specific polymerizable composition on a belt base body, and a publicly known coating process, such as a brush painting process, a flow coating process, a dip coating process, a spray coating process, and a spin coating process, may be applied.

As for the coating amount of a specific polymerizable composition, any amount is acceptable insofar as it is so adjusted for an obtainable specific surface layer to have a predetermined thickness.

Examples of a method for curing a specific polymerizable composition include a heating method and an irradiation method with light such as ultraviolet light.

In the case a specific polymerizable composition is cured by heat, it may be heated, for example, under a condition of 80 to 120° C.

In the case a specific polymerizable composition is cured by irradiation with ultraviolet light, the dose of ultraviolet light is preferably 500 to 3,000 mJ/cm$^2$ from viewpoints of fast curability, and operability.

In the case a specific polymerizable composition is cured by irradiation with ultraviolet light, the temperature is preferably 20 to 80° C.

There is no particular restriction on an irradiation apparatus of ultraviolet light, and a heretofore publicly known one may be used.

From a coated film formed by coating a specific polymerizable composition, a solvent can be removed by drying A coated film may be dried at any time before or after polymerization of a polymerizable component, or during the polymerization, or by selectively combining the above appropriately. Specifically it is preferable to perform primary drying until a coated film loses its fluidity, then to polymerize a polymerizable component, and thereafter to perform further a secondary drying for decreasing the amount of volatile substances in a protective layer to a prescribed amount.

Although a drying method for a coated film cay be selected appropriately according to a solvent type, the thickness of a protective layer to be formed, etc., the drying temperature is preferably, for example, 40 to 100° C. and more preferably approx. 60° C. The drying time is preferably, for example, 1 to 5 min and more preferably approx. 3 min.

The surface of the belt member as described above is composed of a specific cured resin. Consequently, the belt member is superior in the balance between the elasticity derived from a urethane (meth)acrylate (A) and the hardness derived from a polyfunctional monomer (B), and exhibits high tenacity. As the results, good abrasion resistance against a stress from friction or a stress from releasing can be obtained, and therefore even if it is used over a long time period, the low energy characteristic derived from a fluorine-modified acrylate (C) is not compromised significantly, and consequently the initial surface properties can be maintained over a long time period.

For a belt member according to the present invention, the surface hardness of the surface (external circumferential surface) touching a toner layer T measured by a nanoindentation technique is preferably 0.35 to 2 GPa, and more preferably 0.5 to 1 GPa.

When the surface hardness measured by a nanoindentation technique is 0.35 GPa or more, a high gloss treatment belt 2 (belt member) can exhibit good releasability, and when it is 2 GPa or less, superior followability to a toner layer T can be obtained.

The surface hardness is measured by a nanoindentation technique. Specifically, an indenter with a diamond shaped tip is pressed to an external circumferential surface of a nigh gloss treatment belt 2, and the hardness is measured from the load P applied to the indenter and the projective area A formed under the indenter.

The thickness of a high gloss treatment belt 2 (belt member) is preferably 20 to 250 μm. When the thickness of a high gloss treatment belt 2 is in the range, both the operability in conveyance and the thermal conductivity can be superior.

If a high gloss treatment belt 2 has a constitution with a release layer formed (belt member surface layer), the thickness of the release layer is preferably 0.1 to 50 μm, and especially 0.5 to 10 μm.

A specific cured resin, for a belt member according to the present invention can be also used favorably as a surface layer of a roller member having a roller shape such as a fixation roller.

The above belt member can be favorably used as an intermediate transfer belt, or a fixation, belt of a fixation apparatus in various publicly known image formation apparatus based on an electrophotographic technique, such as a black-and-white image formation apparatus and a full-color image formation apparatus.

[Clear Toner]

A clear toner used in a formation process of a glossy surface according to the present invention (hereinafter also referred to simply as "toner") contains toner particles containing a binder res in and a wax. Preferably, a clear toner is composed of toner particles containing a binder resin and a wax. Further, with respect to a clear toner used in a formation process of a glossy surface according to the present invention, the melting energy ΔH determined from a melting peak area obtained from an endothermic peak of a wax obtained by a DSC measurement of a clear toner, is 2 to 20 J/g.

While the ΔH is the melting energy determined from a melting peak area obtained from an endothermic peak of a wax obtained by a DSC measurement of a clear toner, and indicates the amount of a wax contained in a clear toner. In a clear toner according to the present invention the amount is corresponding to the ΔH of 2 to 20 J/g, and preferably the amount corresponding to the ΔH of 4 to 15 J/g.

When the content of a wax in a clear toner is too low (namely, when the ΔH is less than 2), separation of a processed body W from a release roller 5*a* may become difficult, and when the content of a wax in a clear toner is too high (namely, when the ΔH exceeds 20), adhesion of a toner layer on to a surface of a recording material P may become insufficient and a tonner may remain offset on a belt member.

A DSC measurement of a clear toner is carried out using "Diamond DSC" (by PerkinElmer, Inc.) as follows.

According to a specific measuring procedure, firstly 3.0 mg of a clear toner is sealed in an aluminum pan, which is mounted on a holder. As a reference, an empty aluminum pan is used. A temperature regulation for Heating-Cooling-Heating for a measurement was conducted under conditions: measurement temperature of 0° C. to 200° C., temperature increase rate of 10° C./min, and temperature decrease rate of 10° C./min.

The melting energy ΔH (J/g) was a value that was determined by calculating heat per unit mass from an endothermic peak originated from a wax at the 2nd heating.

A clear toner means a toner which color is not recognized by an action of light absorption or light scattering. There is no restriction on a clear toner insofar as it is substantially colorless and transparent, and examples thereof include a toner not containing a coloring agent, such as a pigment, and a dyestuff; a toner containing a coloring agent, such as a pigment, and a dyestuff, only to an unrecognizable extent; and a toner chose transparency is slightly lowered by reason of a binder resin or a wax, or a kind or addition amount of am external additive.

A clear toner is used for a high gloss toner image layer to be obtained by, for example, laminating a layer of the clear toner on toner images formed by chromatic toners, to attain high smoothness, namely high gloss.

Components of a toner particle composing a clear toner will be described below.

[Toner Particle]

[Binder Resin]

A binder resin as a component of a toner particle to be used in a formation process of a glossy surface according to the present invention preferably contains a styrene-acrylic resin.

The content of a styrene-acrylic resin in a binder resin is preferably 50 to 95 mass-%.

When the content of a styrene-acrylic resin in a binder resin is less than 50 mass-%, a toner layer T may not be surely made smooth.

Examples of a resin composing a binder resin other than a styrene-acrylic resin include a polyester resin, a styrenic resin, and a (meth)acrylic resin, and especially use of a polyester resin is preferable. The resins may be used singly or in a combination of 2 or more.

When a polyester resin is used as a resin composing a binder resin other than a styrene-acrylic resin, the content of a polyester resin in a binder resin is preferably, for example, 1 to 70 mass-%.

[Wax]

Examples of a wax composing a toner particle to be used in a formation process of a glossy surface according to the present invention include a polyolefin wax, such as a polyethylene wax, and a polypropylene wax; a branched chain hydrocarbon wax such as a microcrystalline wax; a long chain hydrocarbon wax, such as a paraffin wax, and a Sasol wax; a dialkyl ketone wax such as distearyl ketone; an ester wax, such as a carnauba wax, a montan wax, behenyl behenate, trimethylolpropane tribehenate, pentaerythritol tetrabehenate, pentaerythritol diacetate dibehenate, glycerol tribehenate, 1,18-octadecanediol distearate, tristearyl trimeilitate, and distearyl maleate; and an amide wax, such as ethylenediamine behenylamide, and tristearylamide trimellitate.

Among them, use of those having low crystallinity is preferable by reason that improvement of the clarity of a high gloss toner image layer can be seeked, because there appears no anisotropy during crystallization when solidifying from a molten state, and preferable examples thereof include a paraffin wax, an oxidized polyethylene wax, a polypropylene wax, an oxidized polypropylene wax, a carnauba wax, a Sasol wax, a rice bran wax, a candelilla wax, a jojoba oil wax, and a beeswax.

The content of a wax in a clear toner is indicated by the melting energy ΔH determined from a melting peak area obtained from an endothermic peak of a wax obtained by a DSC measurement of a clear toner as described above. For a clear toner according to the present invention, the content is an amount corresponding to the ΔH of 2 to 20 J/g, and preferably an amount corresponding to the ΔH of 4 to 15 J/g.

[Composition of Clear Toner]

The softening point of a clear toner to be used according to the present invention is preferably 80 to 140° C. from a viewpoint of a fixation property of the toner, and more preferably 90 to 120° C.

The softening point of a toner is measured by a flow tester described below.

Specifically, in an environment of 20° C. and 50% RH, 1.1 g of a toner is placed in a dish and leveled, left standing for 12 hours or more, then pressed at 3820 kg/cm$^2$ for 30 sec by a Handpress SSP-10A (by Shimadzu Corporation) to prepare a cylindrical molded sample with the diameter of 1 cm. Then in an environment of 24° C. and 50% RH, the molded sample is extruded by a piston with the diameter of 1 cm from a hole of a cylindrical die (1 mm diameter×1 mm) of a Flow Tester CFT-500D (by Shimadzu Corporation) under conditions: load of 196 N (20 kgf), initiation temperature of 60° C., preheating time of 300 sec, and temperature increase rate of 6° C./min, after completion of the preheating, and an offset method temperature $T_{offset}$ measured according to a melt temperature measuring method based on a temperature raising method with the offset value of 5 mm is defined as the softening point of a clear toner.

As for the molecular weight of the entire binder resin contained in a clear toner, the number average molecular weight (Mn) is preferably 3,000 to 6,000, and more preferably 3,500 to 5,500, and she ratio (Mw/Mn) of the weight average molecular weight (Mw) to the number average molecular weight (Mn) is 2.0 to 5.0, and preferably 2.5 to 5.5.

The molecular weight of a binder resin contained in a clear toner is measured using a toner as a measurement sample and by gel permeation chromatography (GPC) for a tetrahydrofuran (THF) soluble fraction, specifically as follows.

Namely, an apparatus "HLC-8220" (by Tosoh Corporation) and columns (TSK Guard Column+TSK gel Super HZM-M (3 in series); by Tosoh Corporation) are used and tetrahydrofuran (THF) is fed as a carrier solvent at a flow rate of 0.2 mL/min keeping the column temperature at 40° C., while a measurement sample (toner) is dissolved in tetrahydrofuran to a concentration of 1 mg/mL by a treatment in an ultrasonic disperser at room temperature for 5 min, and filtrated by a membrane filter with the pore size of 0.2 μm to obtain a sample solution, and 10 μL of the sample solution is injected together with the carrier solvent into the apparatus which is detected by a refractive index detector (RI detector) and the molecular weight distribution of the measurement sample is calculated by use of a calibration curve measured with monodisperse polystyrene standard particles. As standard polystyrene samples for a calibration curve measurement, products of Pressure Chemical Company with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ are used and, by measuring at least 10 standard polystyrene samples, a calibration curve is prepared. While, as a detector a refractive index detector is used.

The average particle diameter of the clear toner in terms of the volume-based median diameter is preferably 3 to 10 μm, and more preferably 6 to 9 μm. The average particle diameter of the clear toner can be regulated, for example, by the concentration of a flocculant used (salting-out agent), the timing of addition of a deflocculating agent, the temperature during flocculation, and the polymer composition. When the volume-based median diameter is in the range, the transfer efficiency becomes high, the picture quality of a halftone is improved, and the picture quality of a fine line or dot is improved.

The volume-based median diameter of a clear toner was measured and calculated by an apparatus of "Coulter counter Multisizer 3" (by Beckman Coulter, Inc.) connected with a computer system for data processing (by Beckman Coulter, Inc.).

Specifically, 0.02 g of a toner is added into a 20 mL of a surfactant solution (e.g. a neutral detergent containing a surfactant component is diluted 10-fold with pure water as a surfactant solution for dispersing a toner), made adapted thereto, and then subjected to an ultrasonic dispersion for 1 min to prepare a toner dispersion liquid. The toner dispersion liquid is transferred by a pipette to a beaker containing an electrolytic solution "ISOTON II" (by Beckman Coulter, Inc.) in a sample stand, until the measuring apparatus indicates a concentration of 5 to 10%. By selecting the concentration range, a reproducible measurement value can be obtained. Setting the measuring apparatus at the measured particle count of 25,000 and the aperture diameter of 100 μm, and dividing the measurement range between 2 and 60 μm to 256 divisions, frequency values are calculated, and the volume-based median diameter is defined as a particle diameter at which volume-integrated fraction counted from the higher side reaches 50% (Volume-based D50 diameter).

As for the clear toner, with respect to an individual toner particle constituting the clear toner, the average circularity is preferably 0.850 to 1.000, and more preferably 0.900 to 0.995 from a viewpoint of improvement of transfer efficiency.

When the average circularity is in a range of 0.850 to 1.000, the packing density of toner particles in a toner layer transferred on to a recording material P becomes high to improve the fixation property suppressing fixation offset. Further, breakage of an individual toner particle is suppressed and staining of a friction charge application member is mitigated to stabilise the electrostatic property of a toner.

A value of the average circularity of a toner was measured by "FPIA-2100" (by Sysmex Corporation). Specifically, a toner was made adapted to an aqueous solution containing a surfactant, dispersed by an ultrasonic dispersion treatment for 1 min, and then an image was taken by "FPIA-2100" (by Sysmex Corporation) under measuring conditions of an HPF mode (high magnification imaging; and a proper concentration of 3,000 to 10,000 in terms of the HPF detection number, and the average circularity was obtained by calculation of the circularity for an individual toner particle according to the following formula (T), summation of the respective circularities, and division of the sum by the total particle number. If the HPF detection number is in the range, reproducibility can be assured.

Circularity=(perimeter of a circle having the same projected area as a particle image)/(perimeter of a projected particle image) Formula (T)

[Production Process of Clear Toner]

Examples of a production process of the clear toner include a kneading-grinding process, a suspension polymerisation process, an emulsion aggregation process, a dissolution suspension process, a polyester elongation process, and a dispersion polymerization process.

Among them, use of an emulsion aggregation process is preferable from viewpoints of uniformity in particle diameter advantageous for attaining high picture quality and high stability, shape controllability and easiness in forming a core-shell structure.

An emulsion aggregation process is a production process of a toner particle, in which a dispersion liquid of resin fine particles dispersed with a surfactant and a dispersion stabiliser, is mixed, according to need, with a dispersion liquid of toner particle components, such as fine particles of a coloring agent, followed by addition of a flocculant for aggregation up to an intended particle diameter of a toner. After or simultaneously with the aggregation, resin fine particles are fused together for controlling the shape.

In this regard, resin fine particles may contain optionally internal additives, such as a release agent, and a charge control agent, or may be composite particles formed by a plurality of layers constituted with 2 or more layers composed of resins with different compositions.

Further, it is also preferable from a viewpoint of designing a toner structure to add different kinds of resin fine particles during the aggregation to form a toner particle having a core-shell structure.

Resin fine particles can be produced, for example, by an emulsification polymerization process, a mini emulsion polymerisation process, or a phase inversion emnisifloat ion process, or by a combination of some of the above processes. Among them, in the case an internal additive is added to resin fine particles, use of a miniemulsion polymerization process is preferable.

[External Additive]

Although the toner particle can by itself constitute a toner according to the present invention, for improving fluidity, electrostatic property, cleaning property, etc., a toner according to the present invention may be also constituted with addition of an external additive, namely a so-called post-treatment agent, such as a flow agent, and a cleaning aid, to the toner particle.

Examples of a post-treatment agent include inorganic oxide fine particles, such as silica fine particles, alumina fine particles, and titanium oxide fine particles; inorganic stearate compound fine particles, such as aluminum stearate fine particles, and zinc stearate fine particles; and inorganic titanate compound fine particles, such as strontium titanate, and zinc titanate. The above may be used singly or in a combination of 2 or more.

The inorganic fine particles are preferably treated by a high gloss treatment by means of a silane coupling agent, a titanium coupling agent, a higher fatty acid, or a silicone oil for improving high temperature storage stability or improving environmental stability.

The total addition amount of various external additives is 0.05 to 5 parts by mass with respect to 100 parts by mass of the toner, and preferably 0.1 to 3 parts by mass. As the external additive, various types may be used in combination.

[Developing Agent]

The toner may be used as a magnetic or nonmagnetic 1-component developing agent, but also used as a 2-component developing agent by mixing a carrier. When a toner is used as a 2-component developing agent, as a carrier a magnetic particle made of a heretofore publicly known material including a metal, such as ion, ferrite, and magnetite; and an alloy of the metal with a metal such as aluminum, and lead, may be used and especially a ferrite particle is preferable. Further, as the carrier, a coated carrier, in which a magnetic particle surface is coated with a coating material such as a resin, or a binder-type carrier, in which magnetic material fine powders are dispersed in a binder resin, may be used.

There is no particular restriction on a coating resin composing a coated carrier, and examples thereof include an olefinic resin, a styrenic resin, a styrene-acrylic resin, a silicone resin, an ester resin, and a fluorine resin. Further, there is no particular restriction on a resin composing a resin dispersion-type carrier, and a publicly known resin, such as a styrene-acrylic resin, a polyester resin, a fluorine resin, and a phenol resin, may be used.

The volume-based median diameter of a carrier is preferably 20 to 100 μm, and more preferably 20 to 60 μm. The volume-based median diameter of a carrier may by measured typically by a laser diffraction particle size distribution measuring apparatus "HELOS" (by Sympatec GmbH) equipped with a wet type disperser.

[Formation Process of Glossy Surface]

Next, a formation process of a glossy surface according to the present invention using the belt member and the clear toner will be described below.

A formation process of a glossy surface according to the present invention has a step for heating an image carrier to which a clear toner is supplied; a step for adhering closely the image carrier to a belt member by the intermediary of the clear toner molten in the above step; a step for cooling the image carrier in a state being closely adhered to the belt member; and a step for releasing the image carrier with the clear toner solidified by the cooling from the belt member.

First, an image carrier supplied with a clear toner is yielded. Namely, a processed body W formed by laminating an image by chromatic toners and a clear toner in this order is yielded.

[Recording Material (Carrier)]

There is no particular restriction on a recording material P used in a formation process of a glossy surface according to the present invention, insofar as it can hold a nigh gloss toner image layer, and specific exampled thereof include, but not limited to, various printing substrates, such as plain paper from thin paper to paperboard, fine quality paper, coated paper, coated printing paper such as art paper, coated paper, commercially-supplied Japanese paper, postcard paper, a plastic film for OHP, and cloth.

By the glossy surface forming process, owing to a specific belt member and a specific amount of a wax contained in a clear toner the adhesion and releasability of a clear toner can be adjusted and as the results a uniform glossy surface without unevenness of gloss can be formed on a recording material P.

[Chromatic Toner]

In a formation process of a glossy surface according to the present invention, on a carrier with images formed by chromatic toners, etc. a layer of a clear toner is formed. The chromatic toners forming images are composed of toner particles for electrostatic image development, and preferably of toner particles containing a binder resin and a wax.

In this regard, a chromatic toner means a toner containing a coloring agent with an object of coloring due to light absorption or light scattering.

As a binder resin and a wax constituting a chromatic toner used according to the present invention, similar materials used for the afore-described clear toner can be used favorable.

The content of a wax in a chromatic toner particle is indicated by the melting energy ΔH determined from a melting peak area obtained from an endothermic peak of a wax obtained by a DSC measurement of a toner, and the content of a toner according to the present invention is an amount corresponding to the ΔH of 2 to 20 J/g, and preferably the ΔH of 4 to 15 J/g.

[Coloring Agent]

As a coloring agent contained in a chromatic toner, a commonly known dyestuff and pigment may be used.

As a coloring agent for yielding a black toner, various publicly known materials may be used arbitrarily including carbon black, such as furnace black, and channel black; a magnetic material, such as magnetite, and ferrite; and an inorganic pigment, such as a dyestuff, and a nonmagnetic iron oxide.

Specific examples of a pigment as a coloring agent for yielding a color toner, include C. I. Pigment red 5, ditto 48:1, ditto 53:1, ditto 57:1, ditto 81:4, ditto 122, ditto 139, ditto 144, ditto 149, ditto 166, ditto 177, ditto 178, ditto 222, ditto 238, ditto 269; C. I. Pigment yellow 14, ditto 17, ditto 74, ditto 93, ditto 94, ditto 138, ditto 155, ditto 180, ditto 185; C. I. Pigment orange 13, ditto 31, ditto 43; C. I. Pigment blue 15:3, ditto 60, and ditto 76. Examples of a dyestuff include C. I. solvent red 1, ditto 49, ditto 52, ditto 58, ditto 68, ditto 11, ditto 122; C. I. solvent yellow 19, ditto 44, ditto 77, ditto 79, ditto 81, ditto 82, ditto 93, ditto 98, ditto 103, ditto 104, ditto 112, ditto 162; C. I. solvent blue 25, ditto 36, ditto 69, ditto 70, ditto 93, and ditto 95.

With respect to coloring agents for yielding each color; a single bind or 2 or more kinds in combination may be used for each color.

The number average primary particle diameter of coloring agent (s) in a toner particle varies depending on kind(s) of coloring agent(s); but is in general preferably approx. 10 to 200 nm.

The content of coloring agent(s) in a toner is preferably 1 to 10 mass-%, and more preferably 2 to 8 mass-%. When the content of coloring agent(s) is in the range, an image with good coloring power can be obtained.

[Image Formation Treatment]

A process for yielding an image carrier supplied with a clear toner will be described referring to an example of an image formation apparatus illustrated in FIG. 1

In the image formation apparatus illustrated in FIG. 1, first at the clear toner image formation section 20H and chromatic toner image formation sections 20Y, 20M, 20C, and 20Bk, the photoreceptors 11H, 11Y, 11M, 11C, and 11Bk are charged by the charging means 23H, 23Y, 23M, 23C, and 23Bk, and exposed by the exposure means 22H, 22Y, 22M, 22C, and 22Bk to form electrostatic latent images, and the electrostatic latent images are developed with toners at developing means 21H, 21Y, 21M, 21C, and 21Bk to form a clear toner image as well as chromatic toner images of respective colors, then the clear toner image and the chromatic toner images of respective colors are transferred one by one on to the intermediate transfer body 16 by the primary transfer rollers 13H, 13Y, 13M, 13C, and 13Bk and overlaid one upon another on the intermediate transfer body 16 to form a toner powder layer with unfixed toners.

Meanwhile, the recording material P housed in the paper feeding cassette 41 is supplied by the paper feeding means 42 and conveyed by plural paper supply rollers 44*a*, 44*b*, 44*c*, and 44*d*, and a resist roller 46, and at the secondary transfer roller 13A toner powder layers on the intermediate transfer body 16 are transferred collectively on to the external circumferential surface of the recording material P (on the external circumferential surface of a recording material P is hereinafter also referred to as "on the first surface"). Thereafter, by fixing the toner powder layers transferred to the first surface of the recording material P at the fixation apparatus 26 by pressing and heating, a toner layer T is formed.

The toner powder layers transferred to the first surface of the recording material P are formed by overlaying on the first surface of the recording material P one by one from the side of the recording material P, a black toner layer, a cyan toner layer, a magenta toner layer, a yellow toner layer, and a clear toner layer in the order mentioned, and the toner layer T obtained by fixation at the fixation apparatus 26 has a structure whose uppermost layer is a clear toner layer.

The thickness of a layer from a clear toner in the toner layer T is preferably, for example, 2 to 50 μm.

[Fixation Treatment Conditions]

Next, a processed body W, in which the toner layer T is formed on the first surface of the recording material P, is subjected to a fixation treatment. Namely, an image carrier supplied with a clear toner is treated for fixation.

Preferable conditions for a fixation treatment at a fixation apparatus 26 are: heating temperature of 150 to 230° C., more preferably 160 to 190° C., and nipping time of 10 to 300 msec, more preferably 20 to 70 msec.

The heating temperature at a fixation apparatus 26 means the surface temperature of a heat-pressing roller 27, which touches the toner powder layer transferred on to the recording material P.

While, the nipping time is calculated according to: (Length of nipping section N2 in the travelling direction [mm])/(Linear velocity [mm/sec])*1000

The photoreceptors 11H, 11Y, 11M, 11C, and 11Bk having transferred a clear toner linage or chromatic toner images of respective colors to the intermediate transfer body 16 are used again for next formation of a clear toner image or chromatic toner images of respective colors after removing residual toners on the photoreceptors 11H, 11Y, 11M, 11C, and 11Bk by the cleaning means 25H, 25Y, 25M, 25C, and 25Bk.

Meanwhile, the intermediate transfer body 16 having transferred a clear toner image or chromatic toner images of respective colors en to the recording material P by the secondary transfer roller 13A is used again for next intermediate transfer of a clear toner image and chromatic toner images of respective colors after removing residual toners on the intermediate transfer body 16 by the cleaning means 12.

[High Gloss Treatment]

The processed body W, in which a toner layer T is formed on the first surface of the recording material P by the image formation treatment as above, is subjected to a high gloss treatment.

A high gloss treatment according to the present invention includes a step for heating an image carrier to which a clear toner is supplied; a step for adhering closely the image carrier to a belt member by the intermediary of the clear toner molten in the above step; a step for cooling the image carrier in a state being closely adhered to the belt member; and a step for releasing the image carrier with the clear toner solidified by the cooling from the belt member.

First, the step for heating an image carrier to which a clear toner is supplied, and the step for adhering closely the image carrier to a belt member by the intermediary of the clear toner molten in the above step are performed as follows.

Namely, the processed body W is nipped and driven at the nipping section N by the heating roller 3*a* and the pressing roller 3*b* to be conveyed in a state that a toner layer T of the processed body W is in contact with the smooth surface of the high gloss treatment belt 2. At the nipping section N, the toner layer T is heated to melt and at the same time pressed to copy the smooth surface morphology of the external circumferential surface of the high gloss treatment belt 2 and fused to a form of a layer with uniform thickness (combination of a heating step and a pressing step is hereinafter also referred to collectively as a "heat-pressing step").

By the fusion the processed body W is made in a tightly adhered state to the external circumferential surface of the high gloss treatment belt 2, and with the circulating movement of the high gloss treatment belt 2 in the direction of the arrow, the processed body W is moved together to the cooling region Co where the image carrier is cooled in the closely adhered state to the belt member.

The processed body W is forcibly cooled by air sent from the cooling fans 4*a* to 4*c* during it passes through the cooling mechanism 4 to promote solidification of the toner layer T, thereby smoothing the surface of the toner layer T to form a nigh gloss toner image layer (cooling step).

Next, conveyed to the release mechanism 5, the image carrier with the clear toner solidified by cooling is released from the belt member.

Then the processed body W conveyed to the release mechanism 5 is supported by the auxiliary conveying roller 5*b*, which contacts the back surface (the second surface), and keeping the state reaches eventually a bending section of the high gloss treatment belt 2, where the moving direction of the nigh gloss treatment belt 2 changes abruptly, and due to the stiffness of the recording material P itself constituting the processed body W, the same is released from the high gloss treatment belt 2. Then, by the movement of the center of gravity to the auxiliary conveying roller 5*b*, the release from the high gloss treatment belt 2 is promoted and single-side print having a high gloss toner image layer on the first surface on the recording material P is obtained (release step). The linear velocity in releasing is preferably 20 to 250 mm/sec, and further preferably 20 to 230 mm/sec.

The heating temperature at the neat-pressing step is, for example, 120 to 200° C. and especially preferably 140 to 180° C.

The heating temperature at the heat-pressing step is preferably a temperature, at which the uppermost layer composed of a clear toner in a toner layer T melts during a processed body b passes through the nipping section N, but another layer composed of chromatic toners does not melt.

The heating temperature at the heat-pressing step is defined as a surface temperature of the surface (internal surface) opposite to the smooth surface of the nigh gloss treatment belt 2, when a processed body W is heated and pressed at the nipping section N, and more specifically, the surface temperature of the internal surface of the high gloss treatment belt 2 measured at 5 to 10 cm from the exit of the nipping section b by an infrared radiation thermometer "IR0510" (by Konica Minolta Inc.). The heating temperature at the heat-pressing step can be adjusted specifically by regulating the roller surface temperature of the heating roller 3*a*.

The magnitude of pressing at the heat-pressing step is preferably, for example, 0.80 MPa or less; and more preferably 0.20 to 0.70 MPa. When the magnitude of pressing is in the range, irrespective of the thickness of the toner layer T, a toner layer can tightly adhere to a recording material P.

Although the time duration of the heat-pressing step, namely a time duration in which heat and pressure are applied, depends on the thermal characteristic of a toner composing a toner layer T or the magnitudes of heating temperature and pressing, it is preferably, for example, 0.03 to 0.4 sec and more preferably 0.08 to 0.35 sec.

At the cooling step cooling is performed until the cooled temperature becomes, for example, 30 to 90° C., preferably 40 to 60° C., although it depends on the thermal characteristic of a toner composing a toner layer T.

In this regard, the cooled temperature means a surface temperature of the surface opposite to the smooth surface contacting a toner layer T of the high gloss treatment belt 2 at releasing, and more specifically, the surface temperature of the high gloss treatment belt 2 measured in the cooling region Co by an infrared radiation thermometer "IR0510" (by Konica Minolta Inc.). For example, it is defined as the surface temperature measured 5 to 10 cm before the release point by the release roller 5*a*.

Although an embodiment of the present invention has been specifically described above, embodiments of the present invention are not limited the above example and various modifications may be added thereto.

For example, the high gloss treatment apparatus is not limited to a built-in constitution, and it may, for example, be connected to an appropriate image formation apparatus and used as a finisher.

Further, for example, in a formation process of a glossy surface using an image formation apparatus and a high gloss treatment apparatus with such constitution, after performing the image formation treatment of the first surface external circumferential surface) of a recording material and the high gloss treatment of the first surface, an image formation treatment of the back side (the second surface) of the recording material may be carried out to yield a double-side print.

The formation process of a glossy surface according to the present invention may be conducted by installing separately an image formation apparatus for carrying out the steps up to support of a toner layer on a recording material and a high gloss treatment apparatus, and operating the two in turn.

Further, for example, in the above example of the formation process of a glossy surface, the respective toner layers are as described above formed by conducting a fixation treatment simultaneously to the toner powder layers formed by overlaying chromatic toner images and a clear toner image in the order mentioned on a recording material. However not limited thereto, for example, the toner powder layers from chromatic toner images on a recording material may be first treated for fixation, and then a clear toner image is transferred on to the obtained chromatic toner layer, and the toner powder layer constituted by the clear toner image is treated for fixation to yield a toner layer with a clear toner layer laminated on the chromatic toner layer. When plural kinds of toners are used to yield a toner layer, a toner layer should be preferably yielded by a system, which can treat at the same time a toner powder layer composed of plural kinds of toners for fixation.

Further, for example, in the above formation process of a glossy surface, a toner layer on a processed body to be subjected to the high gloss treatment is solely a layer formed by solidified fixed toners, however, a layer composed solely of powdery unfixed toners may be used, or a layer formed by laminating a layer composed of powdery unfixed toners on a layer composed of solidified fixed toners may be also used.

If a layer composed solely of powdery unfixed toners is used, for example, using an image formation apparatus with a structure identical with the above image formation apparatus except that a fixation apparatus is absent, the fixation treatment and the high gloss treatment may be performed simultaneously in a high gloss treatment apparatus.

Further, if a layer formed by laminating a layer composed of powdery unfixed toners on a layer composed of solidified fixed toners is used, first in the above image formation apparatus the fixed toner layer made of chromatic toners should be formed, and then a layer of unfixed toner of a clear toner should be formed and subjected to a high gloss treatment as a processed body in the high gloss treatment apparatus.

Further, for example, in the formation process of a glossy surface, with respect to a specific practicing method of the release step in a high gloss treatment, it is not limited to a method utilizing the curvature of the release roller 5*a* and the stiffness of a recording material P, and, for example, a method with air blow, or a method using a separating claw may be adopted.

EXAMPLES

Specific examples of the present invention will be described below, provide that the present invention be not limited thereto.

The melting energy ΔH of a clear toner was measured as described above.

A clear toner was produced as follows.

[Preparation Example 1 of Dispersion Liquid of Resin Fine Particle]

(1) First Stage Polymerization

In a reactor provided with a stirrer, a temperature sensor, a condenser, and a nitrogen feed apparatus, a surfactant, solution of 4 parts by mass of sodium poly (oxyethylene) dodecyl ether sulfonate dissolved in 3000 parts by mass of ion exchanged water was charged and the internal temperature was raised to of 80° C. with stirring at a stirring rate of 230 rpm under nitrogen flow.

To the surfactant solution, an initiator solution of 4 parts by mass of a polymerization initiator (potassium persulfate: KPS) dissolved in 200 parts by mass of ion exchanged water was and the liquid temperature was adjusted to 75° C. Then a monomer mixture liquid composed of:

| | |
|---|---|
| styrene | 567 parts by mass |
| n-butyl acrylate | 165 parts by mass |
| methacrylic acid | 68 parts by mass |

was dropped therein over a 1 hour period, and the system was heated at 75° C. for 2 hours with stirring for a polymerization (first stage polymerization) reaction to prepare a dispersion liquid [A1], in which a resin fine particle [A1] was dispersed. The weight average molecular weight of the resin fine particle [A1] was measured to find 300,000.

(2) Second Stage Polymerization

In a reactor provided with a stirrer, a temperature sensor, a condenser, and a nitrogen feed apparatus, a surfactant solution of 2 parts by mass of sodium poly (oxyethylene) dodecyl ether sulfonate dissolved in 1270 parts by mass of ion exchanged water was charged and heated to 80° C., and then the dispersion liquid [A1] in an amount of 40 parts by mass in terms of solid content was added and further a monomer solution dissolving at 80° C. a monomer mixture liquid composed of:

| | |
|---|---|
| styrene | 129 parts by mass |
| n-butyl acrylate | 47 parts by mass |
| methacrylic acid | 15 parts by mass |
| n-octylmercaptan | 0.5 part by mass |
| paraffin wax "HNP-57" (by Nippon Seiro Co., Ltd.) | 82 parts by mass |

was added, and the mixture was dispersed for 1 hour by a mechanical disperser "Cleamix" (by M Technique Co., Ltd.) having a recycle route to prepare a dispersion liquid containing emulsion particle.

Then, to the dispersion liquid an initiator solution of 6 parts by mass of potassium per sulfate dissolved in 100 parts by mass of ion exchanged water was added and the system was heated at 80° C. for 1 hour with stirring for a polymerization (second stage polymerization; reaction to prepare a dispersion liquid [A2], in which a resin fine particle [A2] was dispersed.

(3) Third Stage Polymerization

Into the dispersion liquid [A2] was added an initiator solution of 10 parts by mass of potassium persulfate dissolved in 200 parts by mass of ion exchanged water, and under a temperature condition of 80° C. a monomer mixture liquid composed of:

| | |
|---|---|
| styrene | 417 parts by mass |
| n-butyl acrylate | 131 parts by mass |
| methacrylic acid | 23 parts by mass |
| n-octylmercaptan | 13 parts by mass |

was dropped over a 1 hour period. After completion of dropping, the system was heated with stirring for 2 hours for a polymerisation (third stage polymerization) reaction, and thereafter cooled to 28° C. to yield a resin fine particle dispersion liquid [1], in which a resin fine particle [1] composed of a composite resin fine particle was dispersed.

Production Example 1 of Clear Toner

Example 1

In a reactor provided with a stirrer, a temperature sensor, a condenser, and a nitrogen feed apparatus, 450 parts by mass in terms of solid content of the resin fine particle dispersion liquid [1], 1100 parts by mass of ion exchanged water and 2 parts by mass of sodium dodecyl sulfate were charged and stirred. After adjusting the temperature in the reactor to 30° C., a 5 mol/L aqueous solution of sodium hydroxide was added to adjust the pH to 10.

Next, an aqueous solution of 70 parts by mass of magnesium chloride hexahydrate dissolved in 75 parts by mass of ion exchanged water was added with stirring at 30° C. over 10 min, left standing for 3 min, then heating-up was initiated, and the system was heated up to 85° C. over 60 min, and kept at the constant temperature of 85° C. to continue aggregation and fusion of the resin fine particle [1]. Maintaining the condition, the particle diameter of the aggregated particle being formed was measured by "Multisizer 3" (by Beckman Coulter, Inc.), and when the volume-based median diameter of the aggregated particle reached 6 μm, the aggregation was terminated by adding an aqueous solution of 200 parts by mass of sodium chloride dissolved in 860 parts by mass of ion exchanged water.

After the termination of aggregation, the liquid temperature was raised to 98° C. with heating and stirring as an aging treatment for 8 hours to progress fusion among fine particles of an aggregated particle to form a toner base material particle [1]. After the aging treatment, the liquid temperature was lowered to 30° C., the pH of the liquid was adjusted, to 2 using hydrochloric acid, and stirring was finished.

The obtained toner base material particle [1] was subjected to solid-liquid separation by a basket-type centrifuge "MARK III Model number 60×40" (by Matsumoto Machine Mfg. Co., Ltd.) to yield a wet cake of the toner base material particle [1], and the wet cake was washed in the basket-type centrifuge by 40° C.-ion exchanged water, until the electric conductivity of the filtrate reached 5 μS/cm, and transferred to a "Flash jet dryer" (by Seishin Enterprise Co., Ltd.) for a drying treatment until the water content reached 0.5 mass-% to obtain a toner base material particle [1].

To 100 parts by mass of the toner base material particle [1], an external additive composed of 1.0 part by mass of silica treated with hexamethylsilazane (average primary particle diameter of 12 nm, hydrophobicity of 68) and 0.3 part by mass of titanium dioxide treated with n-octylsilane (average primary particle diameter of 20 nm, hydrophobicity of 63) was added, and an external addition treatment was performed by a Henschel mixer (by Mitsui Miike Machinery Co., Ltd.) to produce a clear toner [1] (median diameter of 6 μm). The external addition treatment by the Henschel mixer was conducted under conditions: circumferential speed of mixing blades of 35 m/sec, treatment temperature of 35° C., and treatment time of 15 mm.

The melting energy ah of the clear toner [1] is shown in Table 1. The measurement method was as described above.

Production Example 2 of Clear Toner

Example 2

A clear toner [2] (median diameter of 6 urn) was produced identically with Production Example 1 of toner, except that the addition amount of the wax "HNP-57" in the second stage polymerization step was changed to 8 parts by mass.

Production Example 3 of Clear Toner

Example 3

A clear toner [3] (median diameter of 6 μm) was produced identically with Production Example 1 of toner, except that the addition amount of the wax "HNP-57" in the second stage polymerization step was changed to 106 parts by mass.

Production Example 4 of Clear Toner

Comparative Example 1

A clear toner [4] (median diameter of 6 μm) was produced identically with Production Example 1 of toner, except that the addition amount of the wax "HNP-57" in the second stage polymerisation step was changed to 4 parts by mass.

Production Example 5 of Clear Toner

Comparative Example 2

A clear toner [5] (median diameter of 6 μm) was produced identically with Production Example 1 of toner, except that the addition amount of the wax "HNP-57" in the second stage polymerization step was changed to 133 parts by mass.

Production Example 6 of Clear Toner

Comparative Example 3

A clear toner [6] (median diameter of 6 μm) was produced identically with Production Example 1 of toner.

Production Example 7 of Clear Toner

Comparative Example 4

A clear toner [7] (median diameter of 6 μm) was produced identically with Production Example 1 of toner.

Production Example 8 of Clear Toner

Comparative Example 5

A clear toner [8] (median diameter of 6 μm) was produced identically with Production Example 1 of toner.

The melting energy ΔH of the toners [2] to [8] are shown in Table 1, The measurement method was as described above.

Production Example 1 of Belt Member (1) Production of Base Body in Form of Endless Belt To a solution of a polyamide acid from 3,3',4,4'-biphenyltetracarboxylic acid dianhydride (BPDA) and p-phenylenediamine (PDA) in N-methyl-2-pyrrolidone (NMP) "U-Varnish S (solid content 18 mass-%)" (by Ube Industries, Ltd.), dried post-oxidized carbon black "SPECIAL BLACK 4" (by Degussa, pH; 3.0, volatile matter: 14.0%) was added in an amount of 23 parts by mass with respect to 100 parts by mass of polyimide type resin solid content, and using a collision disperser "Geanus PY" (by Geanus) the mixture was passed 5 times through a route where the mixture was divided to 2 parts, that were then collided at a pressure of 200 MPa with the minimum area of 1.4 $mm^2$, and the mixture was divided again to 2 parts, and finally mixed to yield a polyamide acid solution containing carbon black.

The polyamide acid solution containing carbon black was coated at 0.5 mm through a dispenser on an inner circumferential surface of a cylindrical mold, which was then rotated at 1500 rpm for 15 min to form a development layer with uniform thickness. Then, rotating at 250 rpm, hot air of 60° C. was blown on the outside of the mold for 30 min, followed by heating at 150° C. for 60 min. Thereafter, the temperature was raised with a temperature increase rate of 2° C./min to 360° C., and heated continuously at 360° C. for 30 min for removing a solvent and water generated by dewatering cyclization, and completing an imide conversion reaction. After cooled down to room temperature, the coat was released from the cylindrical mold to obtain a base body in a form of a 0.1 mm-thick endless belt.

(2) Preparation of Coating Liquid for Surface Layer Formation

| | |
|---|---|
| (A) Component: urethane acrylate "U-6LPA" (by Shin-Nakamura Chemical Co., Ltd.) | 45 parts by mass |
| (B) Component: dipentaerythritol hexaacrylate (DPHA) | 45 parts by mass |
| (C) Component: fluorine-modified acrylate "Megafac RS-72-K" (by DIC Corporation) (effective component 30 mass-%) | 33 parts by mass |
| (D) Component: 1-hydroxycyclohexyl phenyl ketone | 5 parts by mass |

were dissolved in a solvent of propylene glycol monomethyl ether acetate (PMA) to a solid content of 10 mass-% to yield a coating liquid for surface layer formation [1], In this regard, the effective component with respect to the (C) component is fluorine-modified acrylate contained Megafac RS-72-K.

(3) Formation of Surface Layer

On the external circumferential surface of the base body in an endless belt form, the coating liquid for surface layer formation [1] was coated using a coating apparatus by a dip coating process under the following coating condition to form a coated film with the dry film thickness of 5 mm. The coated film was irradiated with ultraviolet light as actinic energy ray under the following irradiation condition for curing the coated film to form a surface layer, thereby yielding a belt member [1]. Irradiation with ultraviolet light was performed by fixing a light source and rotating the base body in a form of an endless belt on which the coated film was formed at a circumferential speed of 60 mm/sec.

—Coating Condition—

Feed rate of coating liquid: 1 L/min

Pulling speed: 4.5 mm/min

—Irradiation Condition with Ultraviolet Light—

Kind of light source: High pressure mercury lamp "H04-L41" (by Eye Graphics Co., Ltd.)

Distance from radiation aperture to coated film surface: 100 mm.

Dose of irradiation light: 1 J/cm$^2$

Irradiation time (Rotating time of base body): 240 sec

Production Examples 2 to 8 of Belt Member

Belt members [2] to [8] were produced identically with Production Example 1 of belt member, except that in the step of preparation of a coating liquid for surface layer formation, coated films for surface layer formation were prepared according to the recipes in Table 1 and used in the formation step of respective surface layers.

The contact angle of a surface of each of the belt members [1] to [8] with respect to pure water is shown in Table 1. Measurements were carried out according to the method as described above.

Examples 1 to 3, Comparative Examples 1 to 5

Test image prints were produced by fixing a full-color image on a recording material "OK TOP COAT+ (basis weight of 157 g/m2, paper thickness of 131 μm)" (by Oji Paper Co., Ltd.) using a digital copier "bizhub C 353" (by Konica Minolta Inc.)

Figure 2:
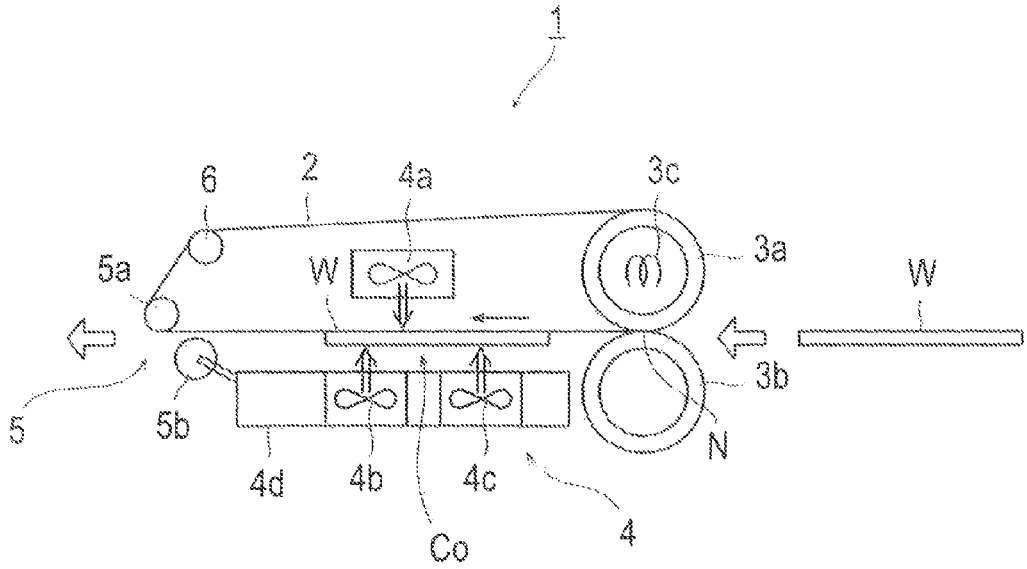
FIG. 2 is a schematic cross-sectional view illustrating an example of a structure of the high gloss treatment apparatus in FIG. 1.

On the entire first surface of the test image print, a clear toner layer was looses using each clear toner [1] to [8] under a condition of the toner coated amount of 4 g/m$^2$ by the image formation apparatus shown in FIG. 1 in a normal temperature environment (temperature 20° C., relative humidity 50% RH), and using the same as a processed body, a high gloss treatment on the first surface was conducted by a high gloss treatment apparatus shown in FIG. 2 using one of the belt members [1] to [8] as a high gloss treatment belt to obtain prints [1] to [8]. The high gloss treatment was continuously carried out up to the 10,000th sheet, and the 1st sheet and the 10,000th sheet of each of the prints [1] to [8] were evaluated.

The conditions of the high gloss treatment apparatus were as follows:

—Constitutional Condition—

(a) Heating roller: An aluminum base body with the outer diameter of 100 mm, thickness of 10 mm, provided internally with a halogen lamp (heat source), which temperature was regulated by a thermistor.

(b) Pressing roller: An aluminum base body with the outer diameter of 80 mm, thickness of 10 mm, the surface of the base body being covered by a 3 mm-thick silicone rubber layer.

(c) Length of nipping section in conveying direction: 11 mm (d) Distance between nipping section and release roller; 620 mm —Regulating Condition—

(e) Heating temperature: In principle, regulated to 155° C.

(f) Magnitude of pressing: 0.29 MPa (g) Cooling temperature: In principle, regulated to 50° C.

(h) Conveying speed of processed body: 220 mm/sec (i) Conveying direction of processed body; Conveyed in the longitudinal direction

[Evaluation: Gloss]

Gloss one venues a of the surface of the first sheet and the 10,000th sheet of the thus obtained prints [1] to [8] and toner offset on the surface layer (release layer) of the belt member after release of a processed body (print) from the belt member were evaluated according to the following methods.

For gloss unevenness, specifically, gloss was measured using a gloss meter "GMX-203" (by Murakami Color Research Laboratory Co., Ltd.) setting a measurement angle at 20° and according to "JIS 28741 1983 Method 2" at 5 points of the center and the four corners, and the difference between the minimum and the maximum was defined as gloss unevenness. The gloss difference less than 10 was accepted as on-specification.

—Evaluation Criteria—

◎: less than 5

○: not less than 5 but less than 10 x: not less than 10

Toner offset was visually evaluated according to the following 3 grades. Grades 2 or higher were accepted as on-specification.

—Evaluation Criteria—

3: Simply no offset

2: Insubstantial offset recognized

1: Substantial offset recognized

The results are shown in Table 1.

TABLE 1

| | Clear toner | | | Belt member | | | | | Evaluation | | | |
|---|---|---|---|---|---|---|---|---|---|---|---|---|
| | | Wax | | | | Cured resin (part by mass) | | (C) *Actual | 1st sheet | | 10,000th sheet | |
| | | (HNP57) (part by mass) | ΔH | | Contact angle | (A) | (B) | amount/ Effective component | Gloss uneven-ness | Releas-ability | Gloss uneven-ness | Releas-ability |
| Example 1 | [1] | 82 | 15 | [1] | 95 | 45 | 45 | 33/10 | ◎ | 3 | ◎ | 3 |
| Example 2 | [2] | 8 | 2 | [2] | 85 | 63 | 36 | 3/1 | ◎ | 2 | ◎ | 2 |
| Example 3 | [3] | 106 | 20 | [3] | 110 | 42 | 18 | 133/40 | ○ | 3 | ○ | 2 |
| Comparative Example 1 | [4] | 4 | 1 | [4] | 95 | 45 | 45 | 33/10 | ○ | 1 | ○ | 1 |
| Comparative Example 2 | [5] | 133 | 25 | [5] | 95 | 45 | 45 | 33/10 | X | 3 | X | 2 |
| Comparative Example 3 | [6] | 82 | 15 | [6] | 80 | 45 | 54.5 | 1.5/0.5 | ○ | 1 | ○ | 1 |
| Comparative Example 4 | [7] | 82 | 15 | [7] | 115 | 30 | 20 | 167/50 | X | 3 | X | 3 |
| Comparative Example 5 | [8] | 82 | 15 | [8] | 95 | 90 | 0 | 33/10 | ◎ | 3 | ○ | 1 |

*(C) component: "Actual amount" means a charged amount of Megafac RS-72-K, and "Effective component" means the amount of a fluorine-modified acrylate contained in Megafac RS-72-K.

According to a formation process of a glossy surface of cine present invention, by constituting the belt member with a specific cured resin to exhibit a specific contact angle, and by adding a specific amount of a wax to the clear toner, the adhesion between a clear toner and a belt member induced by melting of the clear toner and the releasability of the clear toner from the belt member induced by bending of the belt member at a step for releasing can be balanced appropriately. As the results, both appropriate adhesion and releasability between a belt member and a clear toner can be assured, and a formation process of a glossy surface able to form an image without unevenness of gloss in a surface can be provided.

REFERENCE SIGNS LIST

1 High gloss treatment apparatus,
2 High gloss treatment belt,
3*a* Heating roller,
3*b* Pressing roller,
3*c* Heat source,
4 Cooling mechanism,
4*a*, 4*b*, 4*c* Cooling fan,
4*d* Heat sink,
5 Release mechanism,
5*a* Release roller,
5*b* Auxiliary conveying roller,
6 Support roller,
10 Intermediate transfer section,
11H, 11Y, 11M, 11C, 11Bk Photoreceptor,
12 Cleaning means,
13H, 13Y, 13M, 13C, 13Bk Primary transfer roller,
13A Secondary transfer roller,
16 Intermediate transfer body,
16*a* to 16*d* Support roller,
20H Clear toner image formation section,
20Y, 20M, 20C, 20Bk Chromatic toner image formation section,
21H, 21Y, 21M, 21C, 21Bk Developing means,
22H, 22Y, 22M, 22C, 22Bk Exposure means,
23H, 23Y, 23M, 23C, 23Bk Charging means,
25H, 25Y, 25M, 25C, 25Bk Cleaning means,
26 Fixation apparatus,
27, 28 Heat-pressing roller,
40 Paper receiving tray,
41 Paper feeding cassette,
42 Paper feeding means,
44*a*, 44*b*, 44*c*, 44*d* Paper supply roller,
46 Resist roller,
N, N2 Nipping section,
P Recording material, and
W Processed body

What is claimed is:

1. A formation process of a glossy surface comprising:

a step for heating an image carrier to which a clear toner is supplied;

a step for adhering closely the image carrier to a belt member by the intermediary of the clear toner molten in the above step;

a step for cooling the image carrier in a state being closely adhered to the belt member; and a step for releasing the image carrier with the clear toner solidified by the cooling from the belt member;

wherein a surface of the belt member is composed of a cured resin comprising;

(a) a structural unit derived from a urethane (meth)acrylate (A) having 3 or more (meth)acryloyloxy groups in a molecule;

(b) a structural unit derived from a polyfunctional monomer (B) having 3 or more (meth)acryloyloxy groups in a molecule but no urethane bond; and (c) a structural unit derived from a fluorine-modified acrylate(C); and wherein the contact angle of the surface of the belt member with respect to pure water is 85 to 110°;

the clear toner comprises a toner particle comprising a binder resin and a wax; and the melting energy ΔH determined from a melting peak area obtained from an endothermic peak of the wax obtained by a DSC measurement of the clear toner is 2 to 20 J/g.

2. The formation process of a glossy serf ace according to claim 1, wherein the cured resin comprises 18 to 63 mass-% of a structural unit derived from the urethane (meth)acrylate (A), 18 to 63 mass-% of a structural unit derived from the polyfunctional monomer (B), and 1 to 40 mass-% of a structural unit derived from the fluorine-modified acrylate (C).

3. The formation process of a glossy surface according to claim 1, wherein the binder resin comprises a styrene acrylic resin.

4. The formation process of a glossy surface according to claim 1, wherein the surface hardness of a surface (external circumferential surface) of the belt member on the side to be contacted with a toner layer measured by a nanoindentation technique is 0.35 to 2 GPa.

5. The formation process of a glossy surface according to claim 1, wherein a release layer is formed on the belt member and the thickness of the release layer is 0.1 to 50 μm.

6. The formation process of a glossy surface according to claim 1, wherein the softening point of the clear toner is 80 to 140° C.

7. The formation process of a glossy surface according to claim 1, wherein the binder resin contained in the clear toner, the number average molecular weight (Mn) is 3,000 to 6,000 and the ratio Mw/Mn of the weight average molecular weight (Mw) to the number average molecular weight (Mn) is 2.0 to 6.0.

* * * * *